US007795818B2

(12) United States Patent
Urayama et al.

(10) Patent No.: US 7,795,818 B2
(45) Date of Patent: Sep. 14, 2010

(54) MICROWAVE PLASMA GENERATION METHOD AND MICROWAVE PLASMA GENERATOR

(75) Inventors: Takuya Urayama, Hiroshima (JP); Kazunari Fujioka, Hiroshima (JP); Masahiko Uchiyama, Hiroshima (JP)

(73) Assignee: Adtec Plasma Technology Co., Ltd., Hiroshima (JP)

( * ) Notice: Subject to any disclaimer, the term of this patent is extended or adjusted under 35 U.S.C. 154(b) by 336 days.

(21) Appl. No.: 11/992,993

(22) PCT Filed: Sep. 12, 2006

(86) PCT No.: PCT/JP2006/318056

§ 371 (c)(1),
(2), (4) Date: Apr. 1, 2008

(87) PCT Pub. No.: WO2007/040020

PCT Pub. Date: Apr. 12, 2007

(65) Prior Publication Data

US 2009/0128041 A1 May 21, 2009

(30) Foreign Application Priority Data

Oct. 3, 2005 (JP) ..... 2005-290292

(51) Int. Cl.
*H05B 31/26* (2006.01)

(52) U.S. Cl. ..... 315/111.21; 315/111.01; 315/111.11

(58) Field of Classification Search ..... 315/108, 315/110, 111.01, 111.11, 111.21, 111.71, 315/111.81; 219/7
See application file for complete search history.

(56) References Cited

U.S. PATENT DOCUMENTS

| | | | | |
|---|---|---|---|---|
| 4,924,061 | A | 5/1990 | Labat et al. | |
| 5,925,266 | A * | 7/1999 | Gagne | 219/121.48 |
| 2003/0116541 | A1 * | 6/2003 | Chiou et al. | 219/121.51 |

FOREIGN PATENT DOCUMENTS

| | | |
|---|---|---|
| JP | 63-312907 | 12/1988 |
| JP | 03-095899 | 4/1991 |
| JP | 06-104096 | 4/1994 |
| JP | 11-248632 | 9/1999 |

* cited by examiner

*Primary Examiner*—Douglas W Owens
*Assistant Examiner*—Jianzi Chen
(74) *Attorney, Agent, or Firm*—Kirschstein, et al.

(57) ABSTRACT

A microwave plasma generator in which the generating amount of radicals can be regulated easily with higher reaction efficiency while reducing gas consumption. The microwave plasma generator comprises an outer conductor (2), an inner conductor (3) arranged in the internal space (4) of the outer conductor, a discharge tube (7) having a double tube structure consisting of an inner tube (5) and an outer tube (6) and penetrating the outer and inner conductors in the axial direction, and a cavity (1) having a means for adjusting the position of the inner tube to the outer tube in the axial direction in the discharge tube. The microwave plasma generator is further provided with a first gas supply pipe (16), which has a first flow control valve (18) and supplies first gas from a gas cylinder (14) to the outer tube of the discharge tube, a second gas supply pipe (17), which has a second flow control valve (19) and supplies second gas to the inner tube of the discharge tube, a microwave generation source (21), and a microwave supplying passage (22) for supplying microwave from the microwave generation source to the cavity.

5 Claims, 3 Drawing Sheets

MICROWAVE PLASMA GENERATION METHOD AND MICROWAVE PLASMA GENERATOR

TECHNICAL FIELD

The present invention relates to a microwave plasma generation method and a microwave plasma generator and, more particularly, to a method and an apparatus for generating mixture gas plasma by using a double-pipe discharge tube and microwave.

BACKGROUND ART

There is conventionally known a microwave plasma generator including a coaxial microwave cavity with a double-pipe discharge tube which consists of an outer tube and an inner tube and generating mixture gas plasma with microwave (refer to Patent Document 1). In the conventional microwave plasma generator, the inner and outer tubes are fixed to the cavity so as not to be displaced in the axial direction. Each of the inner and outer tubes is a straight tube. The cross section of a gap between the inner and outer tubes, that is, an opening space in a section orthogonal to the axis of the discharge tube is constant.

In the microwave plasma generator of this kind, the amount of active species such as radicals (free radicals) and ions depends on the degree of mixture of a carrier gas and a reactant gas supplied from the inner and outer tubes to the cavity. To generate a desired amount of active species such as radicals and ions, the flow rate and concentration of the gases and the energy of microwave applied to the gases have to be adjusted. In the conventional microwave plasma generator, however, it is difficult to perform the adjustment.

When the discharge tube with such a configuration is used, the efficiency of reaction between the carrier gas and the reactant gas is very low. To obtain plasma having the desired energy, a large amount of the carrier gas and the reactant gas is required.

[Patent document 1] Japanese Laid-Open Patent Publication No. 2000-133494

DISCLOSURE OF THE INVENTION

Problems to be Solved by the Invention

An object of the present invention is, therefore, to provide a microwave plasma generator capable of raising the efficiency of reaction, easily adjusting the amount of active species such as radicals and ions so as to generate the required amount of plasma while reducing gas consumption.

Means for Solving the Problems

To achieve the object, according to a first aspect of the present invention, there is provided a microwave plasma generation method comprising: (A) a step of preparing a cavity comprising an outer conductor with an internal space whose length is an integral multiple of a half of a resonance wavelength, an inner conductor arranged in the internal space of the outer conductor and extending in a length direction of the outer conductor, a double-pipe discharge tube consisting of an inner tube and an outer tube and extending through the outer and inner conductors in a length direction, and adjustment means for adjusting position in an axial direction of the inner tube relative to the outer tube in the discharge tube; (B) a step of supplying a first gas from one end of the discharge tube into the outer tube; (C) a step of forming plasma of the first gas by supplying microwave to the cavity; and (D) a step of adjusting the position in the axial direction of the inner tube by the adjustment means while supplying a second gas from one end of the discharge tube into the inner tube to generate plasma of a mixture of the first and second gases, and releasing the mixture plasma from the other end of the discharge tube.

In the configuration of the first aspect of the present invention, as necessary, the outer tube is tapered at the other end side of the discharge tube.

In the step (D), it is possible to perform any one of the following steps: (1) The position in the axial direction of the inner tube is adjusted while supplying a constant amount of the second gas and, in addition, supplying the third gas from one end of the discharge tube into the inner tube, and the mixture plasma is released from the other end of the discharge tube. (2) The supply amount of the second gas is gradually decreased (and finally stopped). During the period, the third gas is supplied from one end of the discharge tube into the inner tube. While gradually increasing the supply amount, the position in the axial direction of the inner tube is adjusted, and the mixture plasma is released from the other end of the discharge tube. (3) The supply of the second gas is stopped. While supplying the third gas from one end of the discharge tube into the inner tube, the position in the axial direction of the inner tube is adjusted, and the mixture plasma is released from the other end of the discharge tube. (4) The supply of the second gas is stopped and the position in the axial direction of the inner tube is adjusted. After that, the third gas is supplied from one end of the discharge tube into the inner tube. The mixture plasma is released from the other end of the discharge tube.

In the configuration of the first aspect of the present invention, preferably, the adjustment means for adjusting the position in the axial direction of the inner tube relative to the outer tube in the discharge tube comprises: a closing member for closing one end of the outer tube and guiding the inner tube so as to be slidable in the axial direction; a sealing member arranged between the inner tube and the closing member; a rotating handle arranged at the cavity and having a rotary shaft disposed at the outside of the closing member; and a mechanism arranged between a portion of the inner tube projected outward from the closing member and the rotary shaft of the rotating handle for converting a rotational motion of the rotating handle to a reciprocal sliding motion of the inner tube, and the second gas supply pipe is connected to the upper end of the inner tube. Preferably, the motion converting mechanism comprises a rack-and-pinion mechanism. Further, preferably, the rotary shaft of the rotating handle is automatically rotated by a drive device such as a motor arranged at the cavity.

To achieve the object, according to a second aspect of the present invention, there is provided a microwave plasma generator comprising: a cavity having a cylindrically-shaped outer conductor with closed both ends and an internal space whose length is an integral multiple of a half of a resonance wavelength, an inner conductor arranged in the internal space of the outer conductor and extending in an axial direction of the outer conductor, a double-pipe discharge tube consisting of an inner tube and an outer tube and extending through the outer and inner conductors in the axial direction, and adjustment means for adjusting position in an axial direction of the inner tube relative to the outer tube in the discharge tube; a gas supply source independently supplying each of a first gas and a second gas; a first gas supply pipe connecting the gas supply source and the discharge tube so as to supply the first gas into the outer tube of the discharge tube; a first flow control valve installed on the first gas supply pipe; a second gas supply pipe connecting the gas supply source and the discharge tube so as to supply the second gas into the inner tube of the discharge tube; a second flow control valve installed on the second gas supply pipe; a microwave generation source; and a microwave supplying passage for supplying microwave from the microwave generation source to the cavity, wherein the plasma generated from the first and second gases with the microwave in the discharge tube is released from the other end of the discharge tube.

In the configuration of the second aspect of the present invention, preferably, the outer tube is tapered at the other end side of the discharge tube.

In the configuration of the second aspect of the present invention, preferably, the gas supply source can further independently supply a third gas, and the apparatus further includes: a branch pipe branching from a part between the second control valve of the second gas supply pipe and the discharge tube and connected to the gas supply source so as to supply the third gas into the inner tube in the discharge tube; and a third flow control valve installed on the branch pipe.

In the configuration of the second aspect of the present invention, preferably, the adjustment means for adjusting the position in the axial direction of the inner tube relative to the outer tube in the discharge tube includes: a closing member for closing one end of the outer tube and guiding the inner tube so as to be slidable in the axial direction; a sealing member arranged between the inner tube and the closing member; a rotating handle arranged at the cavity and having a rotary shaft disposed at the outside of the closing member; and a mechanism arranged between a portion of the inner tube projected outward from the closing member and the rotary shaft of the rotating handle for converting a rotation motion of the rotating handle to a reciprocal sliding motion of the inner tube, and the second gas supply pipe is connected to the upper end of the inner tube. Preferably, the motion converting mechanism takes the form of a rack-and-pinion mechanism. Further, preferably, the rotary shaft of the rotating handle is automatically rotated by a drive device such as a motor arranged at the cavity.

EFFECTS OF THE INVENTION

According to the present invention, in the microwave plasma generator, the discharge tube has the double-tube structure and the position in the axial direction of the inner tube relative to the outer tube is adjustable. Consequently, the amount of active species such as radicals and ions can be easily adjusted and optimized. Further, the outer tube of the discharge tube is tapered at the plasma release end side. Therefore, the efficiency of reaction in the discharge tube further improves, the required amount of the active species such as radicals and ions can be taken out more easily, and the gas consumption can be reduced.

DESCRIPTION OF REFERENCE NUMERALS

Figure 1:
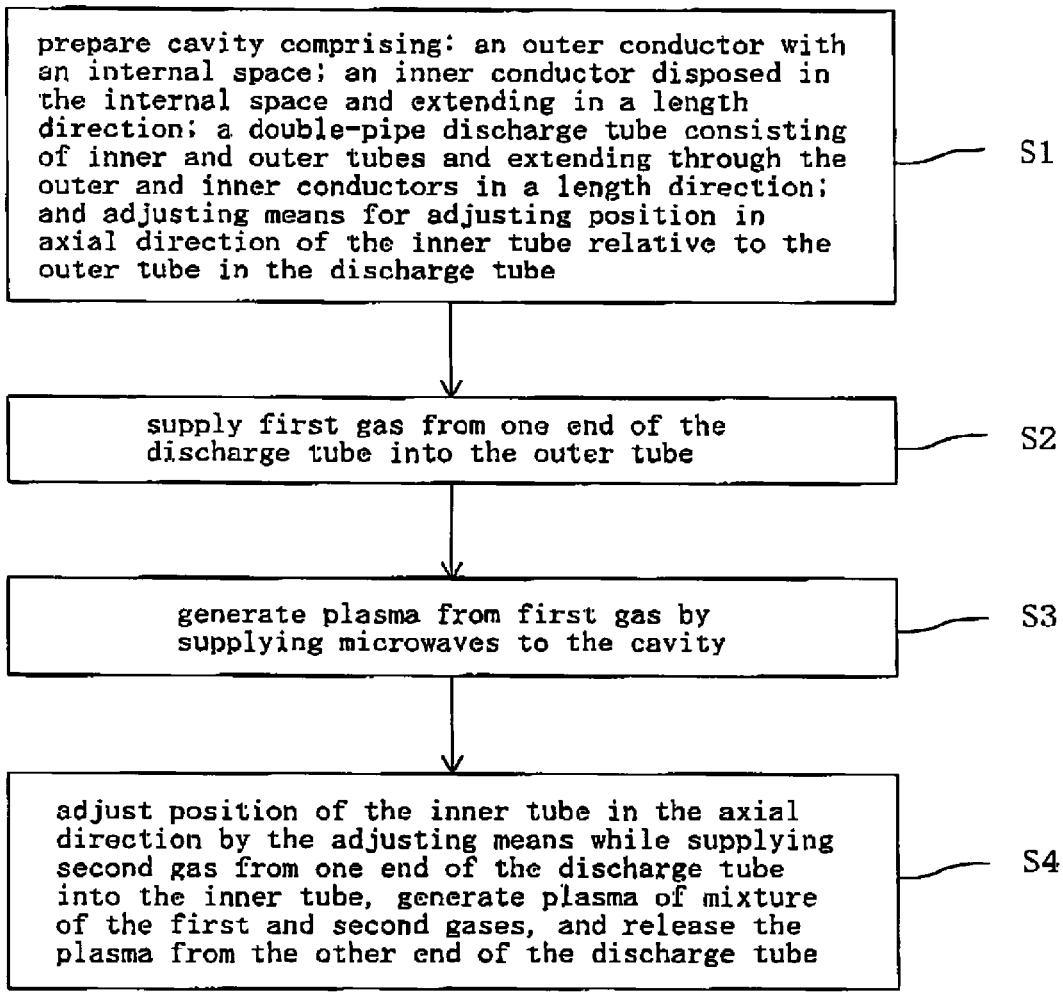
FIG. 1 Flowchart of a microwave plasma generation method according to a first embodiment of the present invention.

1 cavity
2 outer conductor
3 inner conductor
4 space
5 inner tube
5*a* lower end
6 outer tube
6*a* lower end
7 discharge tube
8 sealing member
9 O-ring
10 housing
11 adjustment handle
12 rotary shaft
13 scale
14 first gas cylinder
15 second gas cylinder
16 first gas supply pipe
17 second gas supply pipe
18 first flow control valve
19 second flow control valve
20 gas inlet
21 microwave generation source
22 microwave supplying passage
23 antenna
24 coaxial cable

BEST MODE FOR CARRYING OUT THE INVENTION

Preferred embodiments of the present invention will be described below with reference to the attached drawings. FIG. 1 is a flowchart of a microwave plasma generation method according to a first embodiment of the present invention. With reference to FIG. 1, in the method of the present invention, first, a cavity is prepared. The cavity comprises: an outer conductor with an internal space whose length is an integral multiple of a half of a resonance wavelength; an inner conductor arranged in the internal space of the outer conductor and extending in a length direction of the outer conductor; a double-pipe discharge tube consisting of an inner tube and an outer tube and extending through the outer and inner conductors in a length direction; and adjustment means for adjusting position in an axial direction of the inner tube relative to the outer tube in the discharge tube (step S1 in FIG. 1).

Next, a first gas is supplied from one end of the discharge tube into the outer tube (step S2 in FIG. 1). As the first gas, a rare gas, for example, argon gas is used.

After that, microwave is supplied to the cavity, and plasma is generated from the first gas (step S3 in FIG. 1). The position in the axial direction of the inner tube is adjusted by the adjustment means while supplying a second gas from one end of the discharge tube into the inner tube to generate plasma of a mixture of the first and second gases, and the mixture plasma is released from the other end of the discharge tube (step S4 in FIG. 1). As the second gas, for example, halogen gas may be used. In step S4, the amount of the second gas supplied may be always constant or the amount of the second gas supplied may be varied with time. In the latter case, the position in the axial direction of the inner tube is readjusted as necessary. By adjusting the position in the axial direction of the inner tube relative to the outer tube in the discharge tube as described above, the amount of radicals generated can be easily adjusted with respect to given parameters such as the flow rates and concentrations of the first and second gases. Thus, the amount of the radicals generated can be optimized.

In step S4, it is possible to perform any one of the following steps: (1) The position in the axial direction of the inner tube is adjusted while supplying the constant amount of the second gas and, in addition, the third gas into the inner tube of the discharge tube, and the mixture plasma is released from the other end of the discharge tube. (2) The amount of the second gas supplied is gradually decreased (and finally stopped). During the period, the third gas is supplied into the inner tube of the discharge tube. While gradually increasing the amount of the third gas, the position in the axial direction of the inner tube is adjusted, and the mixture plasma is released from the other end of the discharge tube. (3) The supply of the second gas is stopped. While supplying the third gas into the inner tube in the discharge tube, the position in the axial direction of the inner tube is adjusted, and the mixture plasma is released from the other end of the discharge tube. (4) The supply of the second gas is stopped and the position in the axial direction of the inner tube is adjusted. After that, the third gas is supplied into the inner tube of the discharge tube. The mixture plasma is released from the other end of the discharge tube.

In such a manner, radicals of different kinds can be efficiently generated step by step, or the plasma generated can be stabilized.

When the outer tube is tapered at the other end side of the discharge tube, the plasma generated is narrowed. As a result, the plasma adapted to microfabrication can be obtained. The efficiency of reaction can be further improved, and the gas consumption can be reduced.

Figure 2:
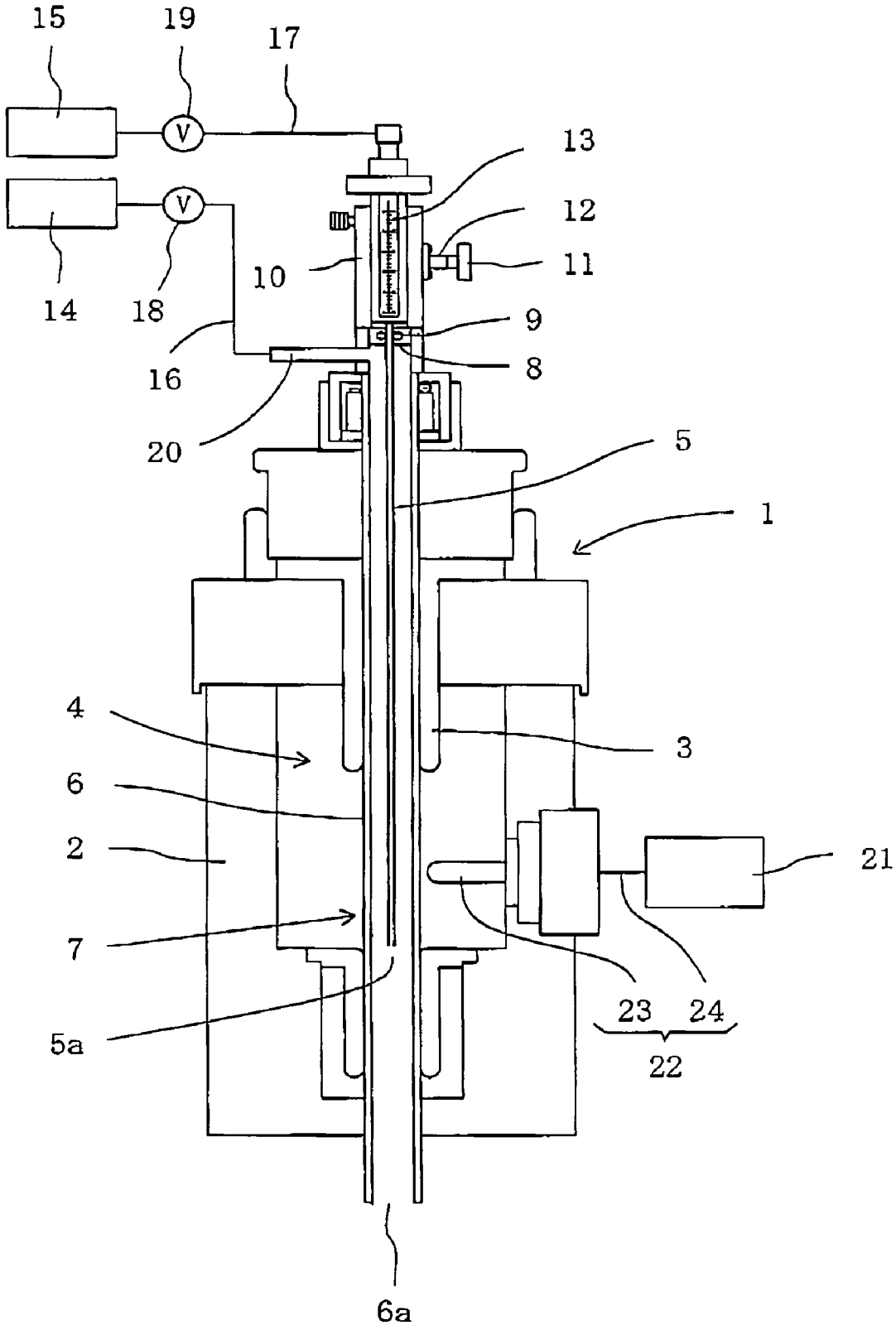
FIG. 2 Vertical section schematically showing the microwave plasma generator according to the first embodiment of the present invention.

FIG. 2 is a vertical section showing a schematic configuration of the microwave plasma generator according to the first embodiment of the present invention. Referring to FIG. 2, the microwave plasma generator of the present invention has a cavity 1. The cavity 1 has an outer conductor 2 and an inner conductor 3. The outer conductor 2 has a cylindrical shape with closed both ends and an internal space 4 whose length is an integral multiple of a half of a resonance wavelength. The inner conductor 3 is arranged in the internal space 4 of the outer conductor 2 and extending in the axial direction.

The cavity 1 also includes: a double-pipe discharge tube 7 consisting of an inner tube 5 and an outer tube 6 and extending through the outer and inner conductors 2 and 3 in the axial direction; and an adjustment mechanism for adjusting position in the axial direction of the inner tube 5 relative to the outer tube 6 in the discharge tube 7. The discharge tube is made of a dielectric material such as quartz.

The adjustment mechanism has: a closing member 8 closing one end (the upper end, in the embodiment) of the outer tube 6 and guiding the inner tube 5 so as to be slidable in the axial direction; and an O-ring 9 arranged between the inner tube 5 and the closing member 8. The O-ring 9 functions as a seal member for preventing gas in the outer tube 6 from being leaked outside during sliding motion of the inner tube 5.

The adjustment mechanism has an adjustment handle 11 attached to a housing 10 so as to be rotatable around a rotary shaft 12. The housing 10 is arranged on the upper end face of the cavity 1 and encloses a portion of the inner tube 8 projected upward from the closing member 8. Although not shown, the adjustment mechanism comprises a rack-and-pinion mechanism arranged between a portion of the inner tube 5 projected outward from the closing member 8 and the rotary shaft 12 of the adjustment handle 11.

By rotating the adjustment handle 11, the inner tube 5 can effect reciprocal slide movement in the axial directions (the vertical directions in the embodiment). In the embodiment, the adjustment handle 11 is rotated by a hand. The rotary shaft 12 can be automatically rotated only by the desired number of revolutions by, for example, a motor driving mechanism or the like. A scale 13 is provided on the outer face of the housing 10, and the movement distance in the axial direction of the inner tube 5 can be measured.

In addition, a first gas cylinder 14 for supplying the first gas and a second gas cylinder 15 for supplying the second gas are provided. In the embodiment, the first gas is a rare gas such as argon gas, and the second gas is halogen gas. The first gas cylinder 14 and a gas inlet 20 of the outer tube 6 of the discharge tube 7 are connected to each other through a first gas supply pipe 16. The second gas cylinder 15 and the upper end of the inner tube 5 of the discharge tube 7 are connected to each other through a second gas supply pipe 17. The first gas supply pipe 16 is provided with a first flow control valve 18, and the second gas supply pipe 17 is provided with a second flow control valve 19. By the first and second flow control valves 18 and 19, the amount of supply of the first and second gases to the discharge tube 7 can be controlled.

The microwave plasma generator further has a microwave generation source 21 and a microwave supplying passage 22 for supply of microwave from the microwave generation source 21 to the cavity 1. The microwave supplying passage 22 has an antenna 23 for the cavity 1 and a coaxial cable 24 connecting the antenna 23 and the microwave supply source 21.

In the embodiment, in the space 4 of the cavity 1, the inner conductor 3 extends from the upper end side (gas supply port side) of the discharge tube 7 toward the lower end side (plasma release port side). Consequently, in the space 4 of the cavity 1, the upper-end-side part of the discharge tube 7 is covered with the inner conductor 3, and the lower-end-side part is exposed. The antenna 23 is arranged in such a manner that the antenna 23 faces the exposed part of the space 4 of the discharge tube 7. However, the arrangement of the inner conductor 3, the discharge tube 7, and the antenna 23 is not limited to the above. For example, the entire discharge tube 7 may be covered with the inner tube 3 in the space 4 of the cavity 1, or the antenna 23 may be arranged in such a manner that it faces the part covered with the inner conductor 3 of the discharge tube 7.

First, in a state where the second flow control valve 19 is closed, the first flow control valve 18 is opened and the first gas is supplied from the first gas cylinder 14 into the outer tube 6 of the discharge tube 7. Microwave is supplied from the microwave generation source 21 to the cavity 1 through the coaxial cable 24 and the antenna 23, so that plasma is generated from the first gas. In this case, the apparatus of the present invention has high reaction efficiency, so that the plasma can be easily ignited without additionally providing a plasma ignition device.

Further, the second flow control valve 19 is opened to supply the second gas from the second gas cylinder 15 into the inner tube 5 of the discharge tube 7. Meanwhile, the adjustment handle 11 is rotated to adjust the position in the axial direction of the inner tube 5 in the discharge tube 7 relative to the outer tube 6, that is, the height level of a lower end 5*a* of the inner tube 5. As a result, plasma of the mixture of the first and second gases is generated in the discharge tube 7 and released from the other end of the discharge tube 7 (the opening at the lower end 6*a* of the outer tube 6), and the generation amounts of the active species such as radicals and ions are optimized. In this case, a constant amount of the second gas may be always supplied or a supply amount of the second gas may be varied with time. In the latter case, the position in the axial direction of the inner tube is readjusted as necessary.

Figure 3:
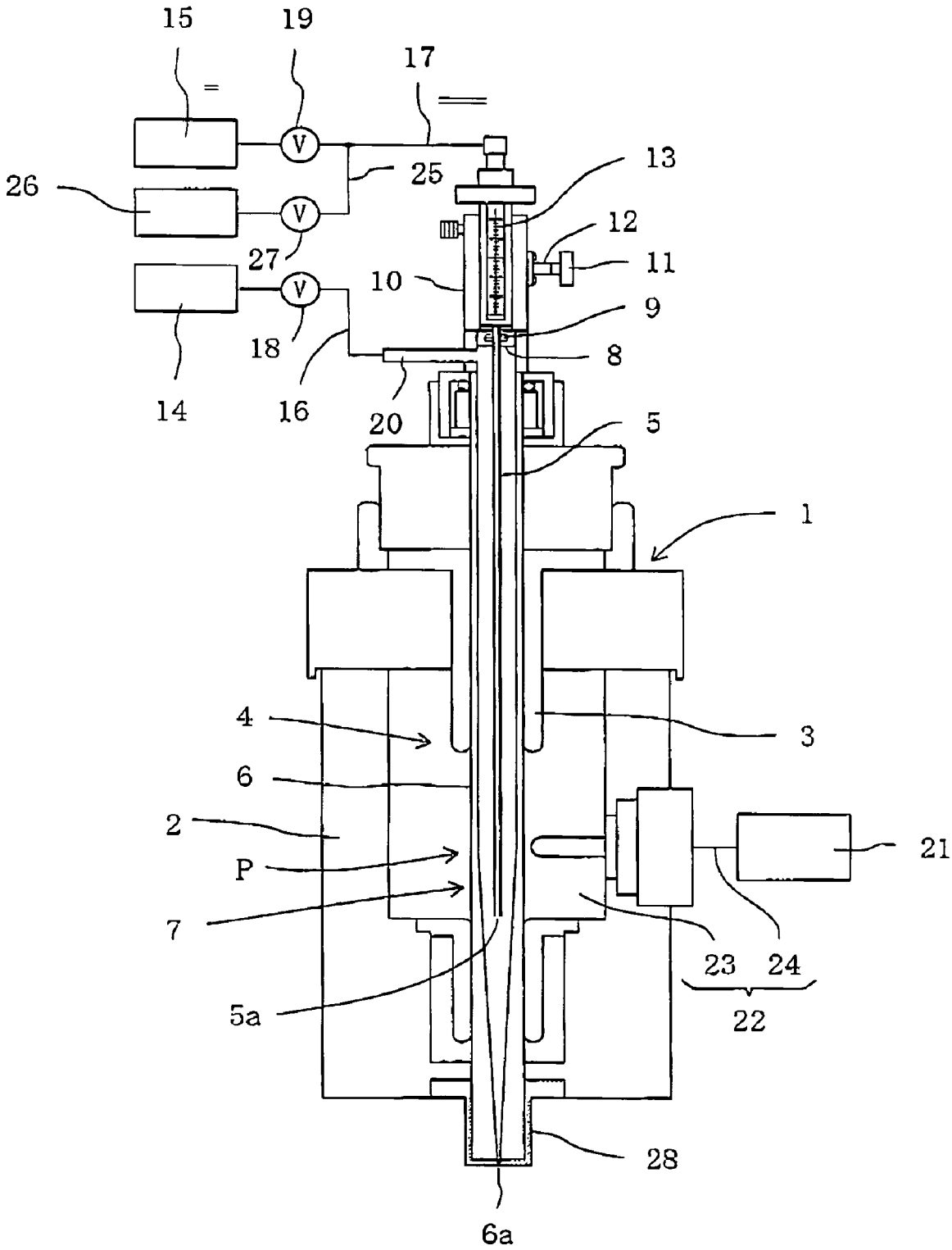
FIG. 3 Vertical section schematically showing a microwave plasma generator according to another embodiment of the present invention.

FIG. 3 is a vertical section of a microwave plasma generator according to another embodiment of the present invention. The another embodiment is different from the embodiment shown in FIG. 2 with respect to the configuration of the outer tube of the discharge tube and the configuration of the gas supply source. Therefore, in FIG. 3, the same reference numerals are designated to the same components as those of FIG. 2 and their detailed description will not be repeated.

With reference to FIG. 3, in the embodiment, the outer tube 6 of the discharge tube 7 is tapered at the lower end side of the discharge tube 7. In this case, as obvious from FIG. 3, the inner tube 5 is formed in such a manner that its outer and inner diameters are always constant in the length direction. On the other hand, the outer diameter of the discharge tube 7, that is, the outer diameter of the outer tube 6 is constant in the overall length. However, the inner diameter of the outer tube 6 is gradually decreased from a predetermined position P in the length direction. In such a manner, the tapered shape of the outer tube 6 is formed.

The lower end part projected from the cavity 1 of the outer tube 6 is covered with a conductor such as a wire mesh 28 to prevent leakage of the microwave.

A third gas cylinder 26 for supplying a third gas is provided. As the third gas, for example, oxygen is used. The third gas cylinder 26 is connected to a pipe 25 branched from a portion between the second control valve 19 of the second gas supply pipe 17 and the discharge tube 7. The pipe 25 is provided with a third flow control valve 27.

In the embodiment, the plasma of the mixture of the first and second gases is released in a manner similar to that in the embodiment of FIG. 2. After that, as necessary, while controlling supply of the second gas, the third gas is supplied, and the position in the axial direction of the inner tube 5 is adjusted. Some concrete examples of the operation will be described below.

(1) The third flow control valve 27 is opened to supply the third gas into the inner tube 5 of the discharge tube 7 while supplying the constant amount of the second gas. Simultaneously, the adjustment handle 11 is rotated to adjust the position in the axial direction of the inner tube 5, and mixture plasma is released from the lower of the discharge tube 7.

(2) The second flow control valve 19 is gradually closed to gradually decrease the amount of the second gas supplied (and finally stopped). During the period, the third Slow control valve 27 is gradually opened to start supply of the third gas into the inner tube 5 of the discharge tube 7. While gradually increasing the amount of the third gas, the adjustment handle 11 is rotated to adjust the position in the axial direction of the inner tube 5, and the mixture plasma is released from the other end of the discharge tube 7.

(3) The second flow control valve 19 is closed to stop the supply of the second gas. The third flow control valve 27 is opened to supply the third gas from the discharge tube 7 into the inner tube 5, meanwhile, the adjustment handle 11 is rotated to adjust the position in the axial direction of the inner tube 5. The mixture plasma is released from the other end of the discharge tube 7.

(4) The second flow control valve 19 is closed to stop the supply of the second gas, and the adjustment handle 11 is rotated to adjust the position in the axial direction of the inner tube 5. After that, the third flow adjusting valve 27 is opened to supply the third gas into the inner tube 5 of the discharge tube 7. The mixture plasma is released from the other end of the discharge tube 7.

In such a manner, active species of different kinds such as radicals and ions can be efficiently generated step by step, or the plasma generated can be stabilized.

Since the outer tube 6 is tapered on the other end side of the discharge tube 7, the plasma generated is narrowed. As a result, the plasma adapted to microfabrication can be obtained. The efficiency of reaction can be further improved, and the gas consumption can be further reduced.

The invention claimed is:

1. A microwave plasma generation method comprising:

a step of preparing a cavity comprising an outer conductor with an internal space whose length is an integral multiple of a half of a resonance wavelength, an inner conductor arranged in the internal space of the outer conductor and extending in a length direction of the outer conductor, a double-pipe discharge tube consisting of an inner tube and an outer tube and extending through the outer and inner conductors in a length direction, and adjustment means for adjusting position in an axial direction of the inner tube relative to the outer tube in the discharge tube;

a step of supplying a first gas from one end of the discharge tube into the outer tube;

a step of forming plasma of the first gas by supplying microwave to the cavity; and a step of adjusting the position in the axial direction of the inner tube by the adjustment means while supplying a second gas from one end of the discharge tube into the inner tube to generate plasma of a mixture of the first and second gases, and releasing the mixture plasma from the other end of the discharge tube.

2. The microwave plasma generation method according to claim 1, wherein the outer tube is tapered at the other end side of the discharge tube.

3. A microwave plasma generator comprising:

a cavity having a cylindrically-shaped outer conductor with closed both ends and an internal space whose length is an integral multiple of a half of a resonance wavelength, an inner conductor arranged in the internal space of the outer conductor and extending in an axial direction of the outer conductor, a double-pipe discharge tube consisting of an inner tube and an outer tube and extending through the outer and inner conductors in the axial direction, and adjustment means for adjusting position in an axial direction of the inner tube relative to the outer tube in the discharge tube;

a gas supply source of independently supplying each of a first gas and a second gas;

a first gas supply pipe connecting the gas supply source and the discharge tube so as to supply the first gas into the outer tube of the discharge tube;

a first flow control valve installed on the first gas supply pipe;

a second gas supply pipe connecting the gas supply source and the discharge tube so as to supply the second gas into the inner tube of the discharge tube;

a second flow control valve installed on the second gas supply pipe;

a microwave generation source; and a microwave supplying passage for supplying microwave from the microwave generation source to the cavity, wherein the plasma generated from the first and second gases with the microwave in the discharge tube is released from the other end of the discharge tube.

4. The microwave plasma generator according to claim 3, wherein the outer tube is tapered at the other end side of the discharge tube.

5. The microwave plasma generator according to claim 3, wherein the gas supply source can further independently supply a third gas, and the generator further comprises:

a branch pipe branching from a part between the second control valve of the second gas supply pipe and the discharge tube and connected to the gas supply source so as to supply the third gas into the inner tube in the discharge tube; and a third flow control valve installed on the branch pipe.

* * * * *